US005692661A

United States Patent [19]

Kellerman

[11] Patent Number: 5,692,661

[45] Date of Patent: Dec. 2, 1997

[54] SPORTS HARNESS FOR A PORTABLE RADIO/CASSETTE PLAYER

[76] Inventor: Theodore J. Kellerman, 28 Cedar La. North, Glen Head, N.Y. 11545

[21] Appl. No.: 561,130

[22] Filed: Nov. 20, 1995

Related U.S. Application Data

[63] Continuation-in-part of Ser. No. 887,330, May 22, 1992, Pat. No. Des. 364,270.

[51] Int. Cl.[6] ..... A45F 3/04

[52] U.S. Cl. ..... 224/648; 224/646; 224/901.4

[58] Field of Search ..... 224/648, 646, 224/645, 638, 629, 666, 668, 911, 912, 901.4, 901.6, 623, 222; D3/218

[56] References Cited

U.S. PATENT DOCUMENTS

| | | | |
|---|---|---|---|
| 2,169,080 | 8/1939 | Clark | 224/646 |
| 2,643,803 | 6/1953 | Bates | 224/5 |
| 3,152,738 | 10/1964 | Worsfold, Jr. | 224/5 |
| 4,033,488 | 7/1977 | Brewer | 224/5 |
| 4,168,022 | 9/1979 | Brewer | 224/257 |
| 4,320,863 | 3/1982 | Lyer et al. | 224/259 |
| 4,461,411 | 7/1984 | Harrow | 224/208 |
| 4,485,276 | 11/1984 | Sato | 179/157 |
| 4,569,465 | 2/1986 | O'Farrell | 224/224 |
| 4,764,962 | 8/1988 | Ekman et al. | 381/24 |
| 4,785,984 | 11/1988 | Seitz-Gangemi | 224/259 |
| 4,941,604 | 7/1990 | Nagareda | 224/160 |
| 5,016,797 | 5/1991 | Rowledge | 224/257 |
| 5,088,634 | 2/1992 | MacLaren | 224/901.4 |
| 5,285,939 | 2/1994 | Hogan | 224/901.4 |
| 5,333,768 | 8/1994 | Krentz | 224/215 |
| 5,353,975 | 10/1994 | Libertucci | 224/224 |
| 5,358,159 | 10/1994 | Lundie, Jr. | 224/638 |
| 5,410,762 | 5/1995 | Maskovich | 2/338 |
| 5,540,364 | 7/1996 | Krieger et al. | 224/666 |

*Primary Examiner*—Henry J. Recla
*Assistant Examiner*—Charles R. Eloshway
*Attorney, Agent, or Firm*—Darby & Darby

[57] ABSTRACT

A sports harness for releasably securing a device such as a portable radio/cassette player device to a wearer, includes an adjustable chest strap, first and second adjustable shoulder straps and first and second adjustable retainer straps. The chest strap has first and second ends for releasably securing the device around the wearer's chest. The first and second shoulder straps each have first and second ends attached to the chest strap so that the first and second shoulder straps are adapted to extend over the wearer's shoulders. The first and second adjustable retainer straps each have first and second ends for releasably retaining the device. The first retainer strap is attached longitudinally to the chest strap and the second retainer strap is attached vertically to the chest strap such that the first and second retainer straps define a substantially rectangular, adjustable space for retaining the device.

20 Claims, 4 Drawing Sheets

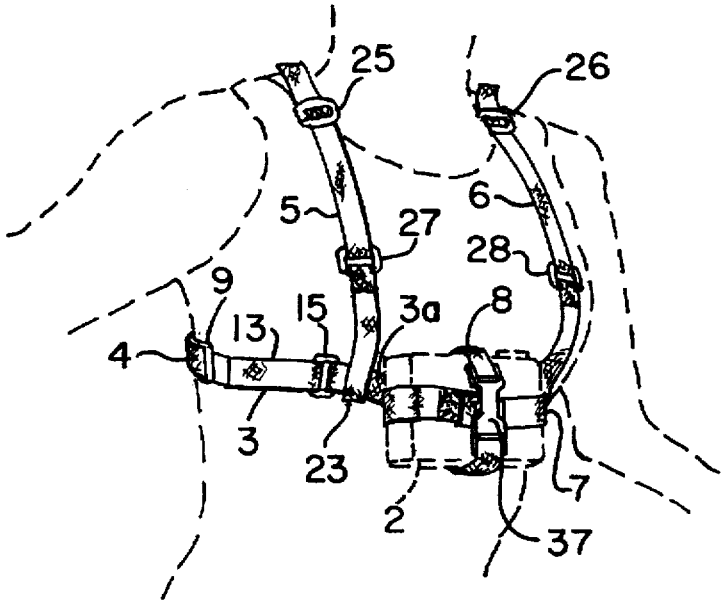
FIG. 1
FIG. 2
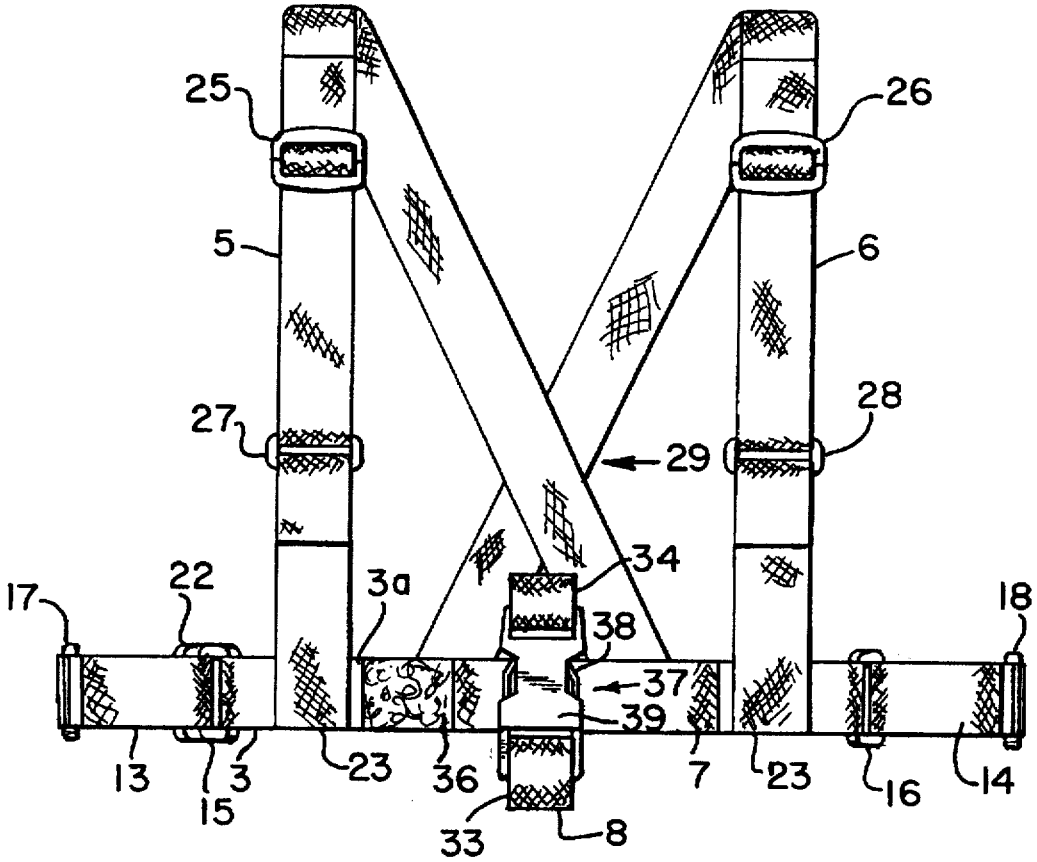

SPORTS HARNESS FOR A PORTABLE RADIO/CASSETTE PLAYER

SPORTS HARNESS FOR A PORTABLE RADIO/ CASSETTE PLAYER

This application is a Continuation-In-Part of application Ser. No. 07/887,330 filed May 22, 1992, now U.S. Design Pat. No. 364,270 granted Nov. 21, 1995, the disclosure of which is hereby incorporated by reference.

FIELD OF THE INVENTION

This invention relates to the field of harness-type carrying devices, and more particularly to a sports harness for releasably securing a portable device such as a radio/cassette player to the chest of a wearer having a chest strap, first and second shoulder straps and first and second retainer straps, wherein the first and second retainer straps are attached to the chest strap and define a substantially rectangular, adjustable space for retaining the device independent of the wearer's clothing and for providing easy access to the controls of the device during usage.

BACKGROUND OF THE INVENTION

Typically, a portable device such as a Sony Walkman® radio/cassette player is used by wearers to listen to broadcasts or audio tapes when engaged in vigorous activities such as jogging, aerobics, rollerblading, bicycle riding, hiking and skiing. These devices are typically worn around the waist of the wearer, attached either to the wearer's belt or clothing by a belt clip. However, when engaged in vigorous exercise, the belt clip is generally insufficient to adequately retain the device and the device may move excessively or become dislodged from the wearer's belt or clothing. In both cases, the radio/cassette player may be damaged, particularly if the player is completely dislodged from the wearer.

Another problem encountered with radio/cassette players is that a user engaged in vigorous exercise may not be wearing a belt or clothing that is capable of receiving a belt clip, for example, women's aerobic leotards. To retain the radio/cassette player in this case, the radio/cassette player is frequently carried in the user's hand. However, this is generally impractical when engaged in most activities, particularly vigorous exercise.

To alleviate these problems, various harnesses and sport belts have been developed to secure a device such as a radio/cassette player to the wearer's body. These harnesses and sport belts prevent the device from moving excessively and from becoming dislodged during vigorous activity without restricting the wearer's hands. However, these harnesses and sport belts contain limitations either in the method of attachment to the wearer or in the limited accessibility to the device's controls during usage.

For example, U.S. Pat. No. 4,461,411, to Harrow, issued Jul. 24, 1984, discloses a harness having a neck strap attached to an abdominal strap for retaining a camera. The camera is attached to the neck strap by two clips as in conventional camera straps. However, additional retaining straps are attached to the abdominal strap and positioned around the cameras lens, using a hook and loop fastener system such as Velcro®, to retain the camera against the abdominal area of the wearer. Since the clips attach the camera directly to the neck strap, 100% of the cameras weight is transferred to the wearer's neck. As a result, the Harrow reference would not be desirable for vigorous athletic activity.

U.S. Pat. No. 4,764,962 to Ekman et al., issued Aug. 16, 1988, discloses a pouch for retaining a radio/cassette player which is attached directly to the wearer's clothing, preferably by a pair of conventional suspenders. This type of retaining system transfers the weight of the radio/cassette player to the wearer's shoulders, which is more desirable than transferring the weight to the wearer's neck. However, since the pouch of the Ekman et al. reference must be attached directly to the wearer's clothing, the pouch, including the radio/cassette player, may become dislodged during vigorous exercise. In addition, the Ekman et al. reference retains the radio/cassette player by completely enclosing the device within the pouch, thereby restricting access to the controls of the radio/cassette player during usage.

Similarly, U.S. Pat. No. 4,569,465 to O'Farrell, issued Feb. 11, 1986, discloses a sports belt having a belt strap adapted to receive a radio/cassette player within a sleeve positioned on an internal surface of a symmetrical belt. Although the O'Farrell reference retains the radio/cassette player in a stationary position, the wearer is unable to adjust the device's controls without removing the belt and accessing the device from within the internal sleeve. Therefore, as with the Ekman et al. reference, the wearer of the O'Farrell reference would have to interrupt an exercise routine to change radio stations, cassettes or otherwise adjust the controls of the device.

Likewise, U.S. Pat. No. 5,410,762 to Maskovich, issued May 2, 1995, discloses a belt strap having a belt and elastic strap. The elastic strap has two slots, one on each end, through which the belt is inserted. The radio/cassette player is inserted between the belt and elastic strap which retains the radio/cassette player. As with the prior art, in the preferred embodiment, the wearer cannot access the radio/cassette player's controls without completely removing the elastic strap or completely removing the radio/cassette player from the belt, both of which minimize the effectiveness of the belt strap and interrupt the exercise routine or activity.

In an alternate embodiment of the Maskovich '762 reference, the elastic strap is formed of two separate flaps which are joined using a hook and loop fastener system. In this embodiment, the wearer can access the radio/cassette player's controls without removing the player from the belt by opening the flaps of the elastic strap. However, when the flaps of the elastic strap are opened, the elastic strap no longer serves to retain the radio/cassette player and it may become dislodged from the wearer.

Therefore, what is needed is an adjustable sports harness for releasably securing a portable device, such as a radio/cassette player, to a wearer, wherein the sports harness is worn independently of the wearer's clothing and provides easy access to the controls of the portable device during usage without compromising the retention features of the harness.

SUMMARY OF THE INVENTION

Accordingly, it is an object of the present invention to provide an improved sports harness which is worn independently of the wearer's clothing and which provides easy access to the controls of a portable device, such as a radio/cassette player, during usage while retaining the portable device securely on the wearer.

It is a further object of the present invention to provide a sports harness, comprising an adjustable chest strap having first and second ends for releasably securing a device, such as a radio/cassette player, around the wearer's chest, first and second adjustable shoulder straps, each having first and second ends attached to the chest strap so that the first and second shoulder/traps are adapted to extend over the wearer's shoulders, and first and second retainer straps, each having first and second ends for releasably retaining the device, the first retainer strap being attached longitudinally to the chest strap and the second retainer strap being attached vertically to the chest strap, wherein the first and second retainer straps define an adjustable space for retaining the device.

BRIEF DESCRIPTION OF THE DRAWINGS

FIG. 1 is a perspective view of the preferred sports harness as worn by a wearer according to the present invention.

FIG. 2 is a front view of the preferred sports harness according to the present invention.

DETAILED DESCRIPTION OF THE INVENTION

Figure 3:
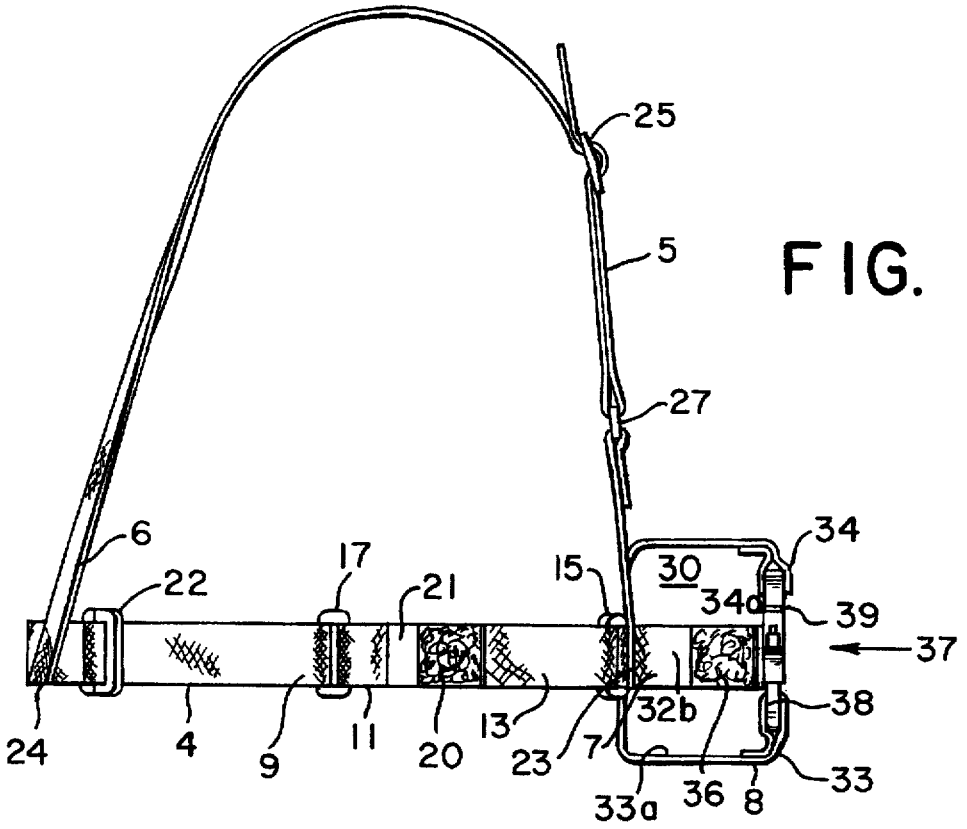
FIG. 3 is a right side view of the preferred sports harness according to the present invention.
Figure 4:
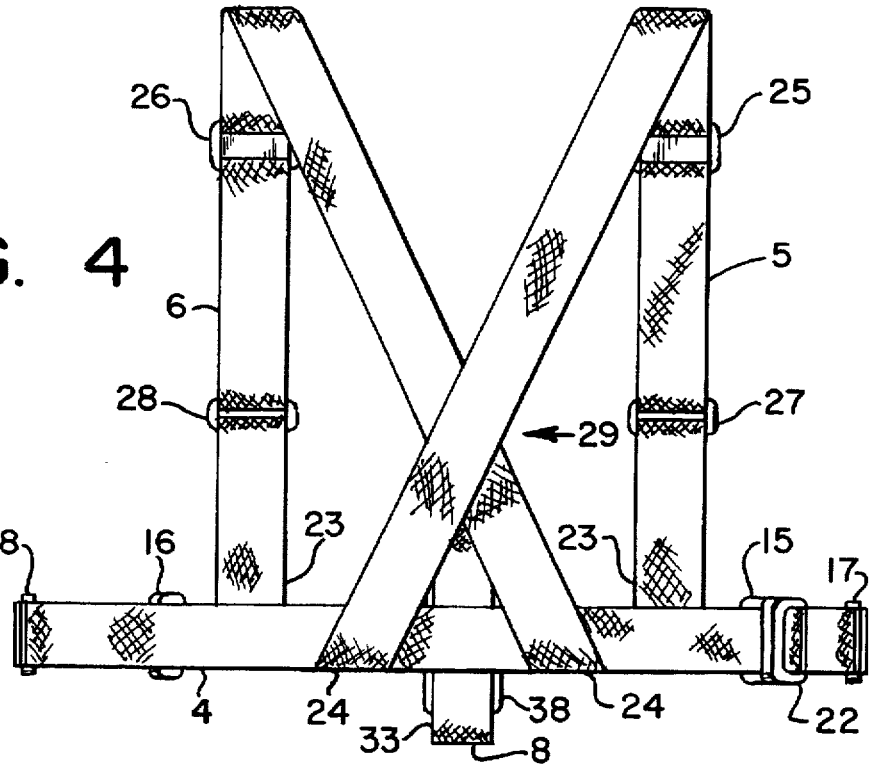
FIG. 4 is a back view of the preferred sports harness according to the present invention.
Figure 5:
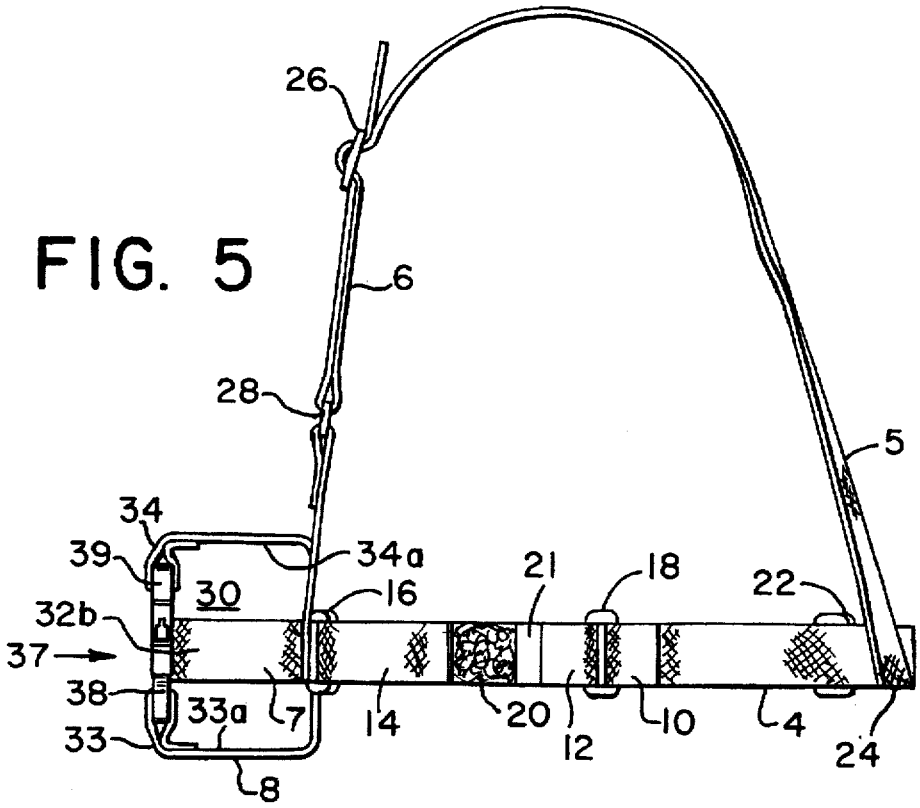
FIG. 5 is a left side view of the preferred sports harness according to the present invention.
Figure 6:
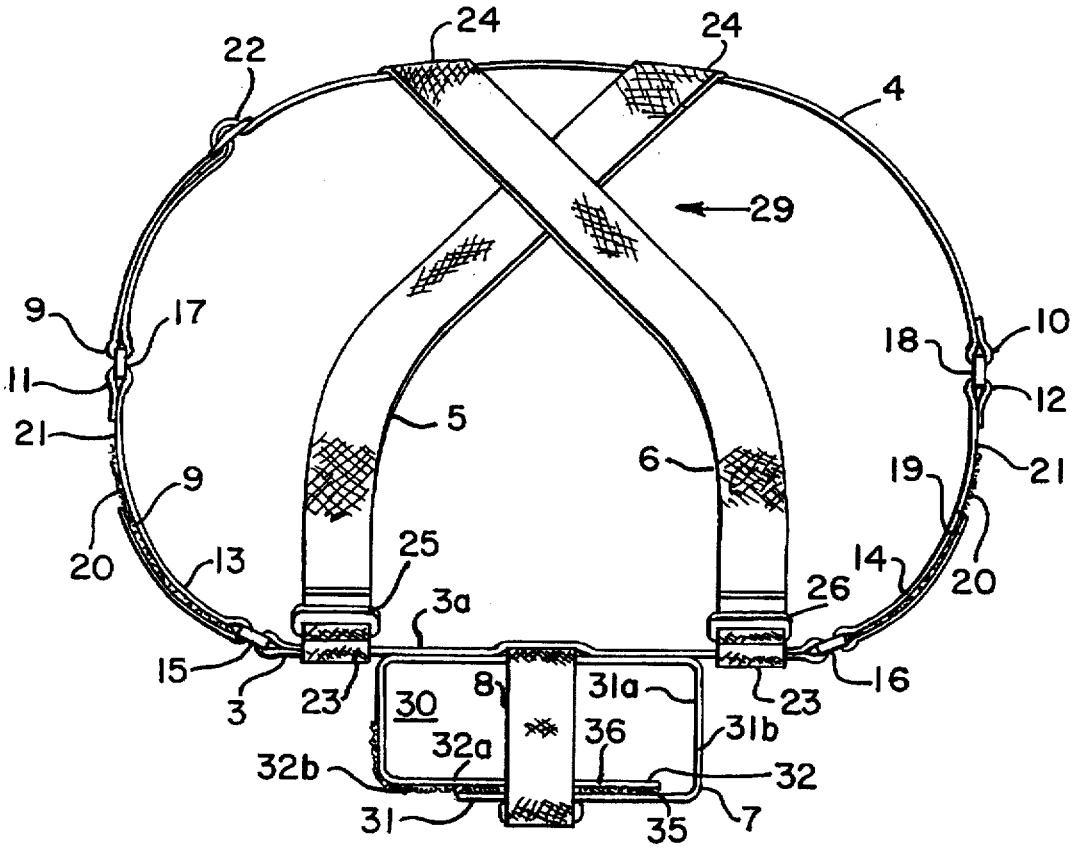
FIG. 6 is a top view of the preferred sports harness according to the present invention.

Referring to FIGS. 1–6, a preferred sports harness 1 for releasably securing a portable device such as a radio/cassette player 2 to a wearer includes an adjustable chest strap 3 having an elastic portion 4, first and second adjustable shoulder straps 5, 6 and first and second adjustable retainer straps 7, 8. The chest strap 3 preferably includes the elastic portion 4 having first and second ends 9, 10 attached to first and second ends 11, 12, respectively, of the chest strap 3 for releasably securing the radio/cassette player 2 around the wearer's chest. Alternatively, the first and second ends 9, 10 of the chest strap 3 can be attached directly to one another, eliminating the elastic portion 4, without deviating from the intent of the invention.

Preferably, the chest strap 3 includes first and second adjustment portions 13, 14 which engage connecting loop locks 15, 16, respectively, at each end of a chest strap portion 3*a*, which is the front of the sports harness 1. Likewise, the first and second adjustment portions 13, 14 engage connecting loop locks 17, 18 at each end of the elastic portion 4, although these portions 3*a*, 4, 13, 14 may be assembled in a variety of ways without deviating from the intent of the invention. In addition, the connecting loop locks 15, 16, 17 and 18 are preferably rectangular but may comprise a variety of configurations.

The first and second adjustment portions 13, 14 each comprise a plurality of hooks 19 and loops 20 such as Velcro® attached to a surface 21 of the chest strap 3 to enable the adjustment portions 13, 14 to be individually adjusted by inserting the portions 13, 14 through the connecting loop locks 15, 16, respectively, and engaging the hooks 19 with the loops 20. Preferably, an additional means of adjustment is provided by a slide 22 positioned on the elastic portion 4 for adjusting the chest strap 3. Alteratively, the chest strap 3 may be provided with only one adjustment portion 13 or no adjustment portions 13, 14. Likewise, the slide 22 may be eliminated, resulting in the chest strap 3 being retained solely by the elastic portion 4 without deviating from the intent of the invention.

The first and second adjustable shoulder straps 5, 6, each have first and second ends 23, 24 attached to the chest strap 3 so that the first and second shoulder straps 5, 6 are adapted to extend over the wearer's shoulders. Preferably, the first ends 23 are fixedly attached to the front of the sports harness 1, the chest strap portion 3*a*, while the second ends 24 are movably attached to the back of the sports harness 1, the elastic portion 4. The first ends 23 are preferably sewn to the chest strap portion 3*a* while the second ends 24 are movably attached to the elastic portion 4, wherein the second ends 24 comprise a fixed loop through which the elastic portion 4 is inserted. In this way, the first ends 23 are fixed to the chest strap 3 while the second ends are capable of moving along the elastic portion 4.

The first and second ends may be attached to the chest strap 3 in a variety of ways without deviating from the intent of the invention. For example, the first ends 23 may be movably attached to the chest strap and/or the second ends 24 may be fixedly attached to the elastic portion 4. Likewise, the first ends 23 may be attached substantially at the center of the chest strap portion 3*a* without deviating from the intent of the invention. In addition, the chest strap 3 and shoulder straps 5, 6 preferably comprise a flat polypropylene web and the elastic portion 4 comprises a poly-elastic material; however, the sports harness 1 may comprise other materials without deviating from the intent of the invention.

For adjustment purposes, the shoulder straps 5, 6 have slides 25, 26, respectively, for adjusting the shoulder straps 5, 6 in conjunction with connecting loop locks 27, 28 which are preferably rectangular. The shoulder straps 5, 6 form a crisscross configuration 29 along the back of the sports harness 1 to provide greater stability to the harness 1, and ultimately the device 2. The shoulder straps 5, 6 may form a variety of configurations without deviating from the intent of the invention. For example, the shoulder straps 5, 6 may form the crisscross configuration 29 in the front as with the second ends 24 of the back of the harness 1 for the increased comfort of the wearer, particularly women. Likewise, the shoulder straps 5, 6 may utilize a plurality of slides 25, 26 and/or connecting loop locks 27, 28 or no slides 25, 26 and/or connecting loop locks 27, 28 without deviating from the intent of the invention.

The first and second adjustable retainer straps 7, 8 are attached to the chest strap 3, specifically, the chest strap portion 3*a*, and define a substantially rectangular, adjustable space 30 (FIGS. 3, 5 and 6) for retaining the device 2. The first retainer strap 7 is attached longitudinally to the chest strap portion 3*a* while the second retainer strap 8 is attached vertically to the portion 3*a*. The adjustable space 30 is preferably substantially rectangular but could be adapted to accommodate a variety of shapes and sizes, for example cameras, binoculars, compact disc players and other electronic devices, and is thus, not limited to retaining radio/cassette players 2.

Preferably, the first retainer strap 7 has first and second ends 31, 32 which are detachably coupled using a plurality of hooks 35 and loops 36 such as Velcro® to releasably retain the device 2 in the longitudinal direction. The plurality of hooks 35 is positioned on an internal surface 31*a* of the first end 31 of the first retainer strap 7 and the plurality of loops 36 is positioned on an external surface 32*b* of the second end 32. The first and second ends 31, 32 of the first retainer strap 7 secure the device 2 within the adjustable space 30 of the sports harness 1 in the longitudinal direction by engaging the hooks 35 of the internal surface 31*a* with the loops 36 of the external surface 32*b*.

Preferably, the second retainer strap 8 has first and second ends 33, 34 which are detachably coupled using a side release buckle 37, preferably plastic, to retain the device 2 in the vertical direction. The first and second ends 33, 34 of the second retainer strap 8 have flexible fingers 38 and a cavity 39, respectively, which are engaged to form the side release buckle 37. The first and second ends 33, 34 have first and second internal surfaces 33*a*, 34*a* which engage the device 2 upon engagement of the side release buckle 37.

In operation, the first retainer strap 7 is first detachably coupled using the hook and loop fastener system 35, 36 and the second retainer strap 8 is detachably coupled using the side release buckle 37. As a result, in the preferred embodiment, the adjustable space 30 comprises the internal surface 31*a* and an internal surface 32*a* of the longitudinal retainer strap 7 and the internal surfaces 33*a*, 34*a* of the vertical retainer strap 8.

The first and second retainer straps 7, 8 may be detachably coupled in a variety of ways without deviating from the intent of the invention. For example, the first and second straps 7, 8 may both be detachably coupled using the hook and loop fastener system 35, 36 and/or the side release buckle 37. In addition, the device 2 may be retained using the longitudinal retainer strap 7 and two vertical retainer straps 8, one positioned at each end of the device 2 so as not to interfere with the controls of the device 2. In this type of configuration, the first and/or second retainer straps 7, 8 may be formed of an elastic material, and therefore, not require any form of detachable coupling device on either strap 7, 8. In this way, the expandable elastic straps 7, 8 are also attached to the chest strap 3 and define the space 30 for retaining the device 2 independently of the wearer's clothing and for providing easy access to the controls of the device 2 during usage.

Unlike the prior art, the substantially rectangular space 30 retains the device 2 independent of the wearer's clothing. As a result, the wearer is not restricted to the type of clothing worn nor the positioning or placement of the device 2. In addition, the sports harness 1 provides easy access to the device 2 during usage without the need to interrupt the exercise routine or other activity to adjust the controls of the device 2.

Figure 7:
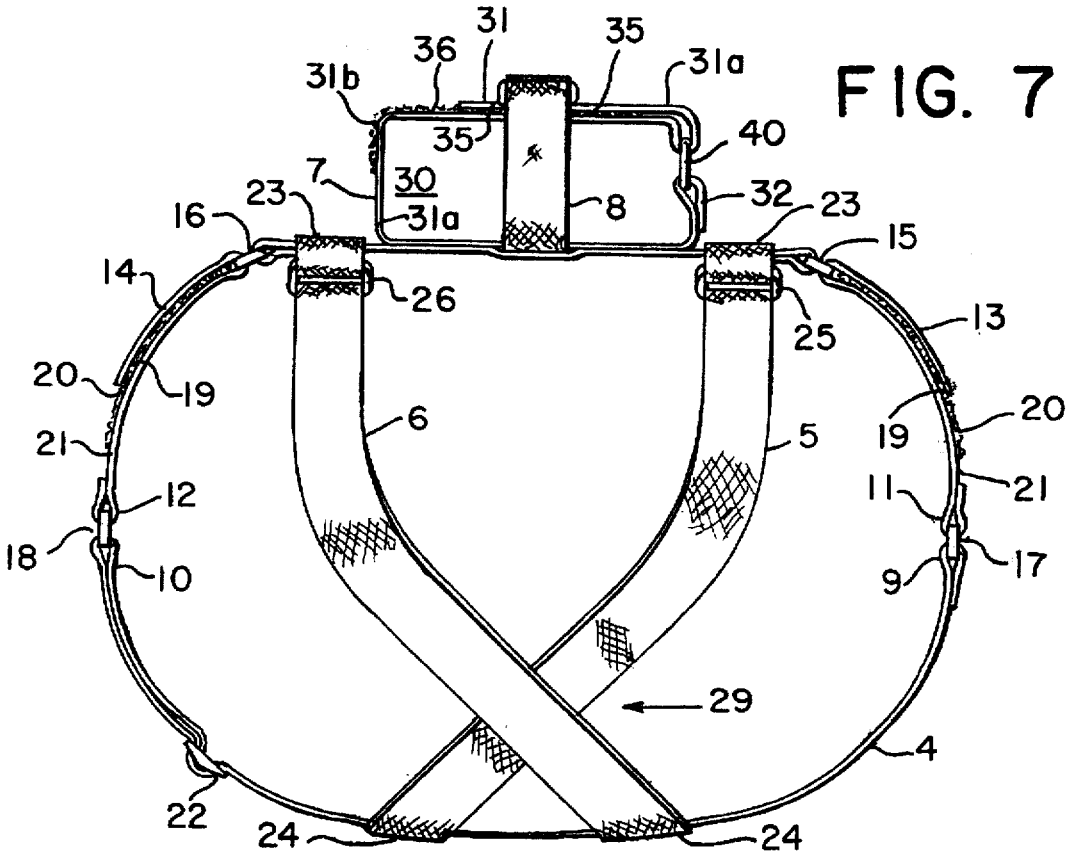
FIG. 7 is a top view of an alternate sports harness according to the present invention.
Figure 8:
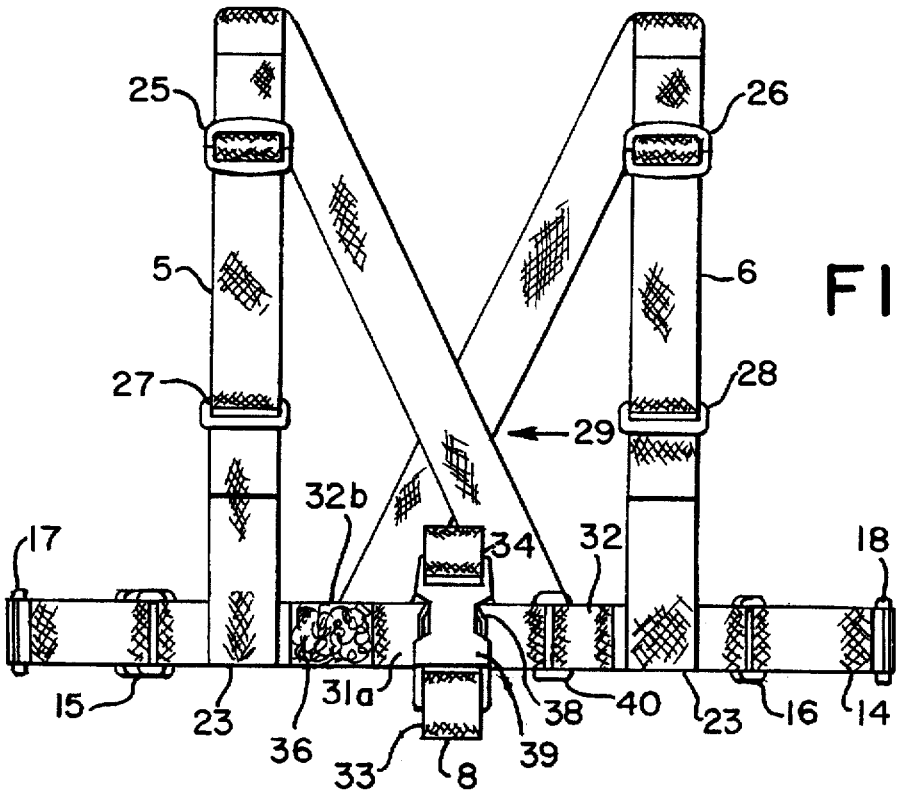
FIG. 8 is a front view of an alternate sports harness according to the present invention.

Referring to FIGS. 7 and 8, an alternate sports harness 1*a* includes the elements of the preferred sports harness 1 with the addition of a loop lock 40 attached to the second end 32 of the first retainer strap 7 and a modification to the positioning of the hook and loop fastener system 35, 36. Specifically, the hooks 35 and loops 36 are both positioned on an external surface 31*b* of the first end 31 of the first retainer strap 7. The first end 31 is inserted within the loop lock 40 and folded such that the hooks 35 on the external surface 31*b* engage the loops 36. In this way, the first end 31 of the longitudinal retainer strap may be tightened without adjusting the position of the second end 32.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. An apparatus for releasably securing a portable device to a wearer, said device having a substantially rectangular shape defined by a first pair of spaced apart generally vertical walls parallel to said article, a second pair of spaced apart generally vertical walls extending away from said apparatus and a pair of spaced apart generally horizontal walls at respective upper and lower ends of said first and second pairs of vertical walls, said apparatus comprising:

an adjustable chest strap for releasably securing the device around the wearer's chest;

first and second adjustable shoulder straps, each having first and second ends attached to said chest strap so that said first and second shoulder straps are adapted to extend over the wearer's shoulders; and first and second retainer straps for releasably retaining the device, each of said retainer straps having first and second ends, and each of said retainer straps having means for releasably engaging said first and second ends, said first and second retainer straps attached to said chest strap at a common attachment point, said first retainer strap attached to said chest strap in an orientation perpendicular relative to said second retainer strap, said first retainer strap attached longitudinally to said chest strap and said second retainer strap attached vertically to said chest strap, wherein said first and second retainer straps define a substantially rectangular space for retaining the device so that said longitudinally attached first retainer strap is positioned about said device to substantially engage said first and second pairs of spaced apart generally vertical walls, and said vertically attached second retainer strap is positioned about said device to substantially engage said first pair of spaced apart generally vertical walls and said pair of spaced apart generally horizontal walls.

2. The apparatus of claim 1, wherein said adjustable chest strap has first and second ends detachably coupled by a hook and loop fastener system.

3. The apparatus of claim 1, wherein said adjustable chest strap has first and second ends detachably coupled by a side release buckle.

4. The apparatus of claim 1, wherein said adjustable chest strap further comprises an elastic portion.

5. The apparatus of claim 4, wherein said elastic portion of said adjustable chest strap extends substantially opposite of said first and second retainer straps.

6. The apparatus of claim 4, wherein at least a first end of said adjustable chest strap comprises a hook and loop fastener system and at least a first end of said elastic portion comprises a connecting loop lock, said first end of said adjustable chest strap is detachably coupled to said connecting loop lock by said hook and loop fastener system.

7. The apparatus of claim 4, wherein said first and second ends of said elastic portion each comprise a connecting loop lock, first and second ends of said adjustable chest strap are detachably coupled to said connecting loop locks by a hook and loop fastener system positioned on each of said first and second ends of said chest strap.

8. The apparatus of claim 1, wherein said first and second shoulder straps form a crisscross configuration, substantially opposite said first and second retainer straps.

9. The apparatus of claim 1, wherein said first and second shoulder straps form a crisscross configuration, substantially adjacent said first and second retainer straps.

10. The apparatus of claim 1, wherein said substantially rectangular space is adjustable.

11. The apparatus of claim 1, wherein at least one of said first and second retainer straps is adjustable.

12. The apparatus of claim 1, wherein at least one of said first and second retainer straps is detachably coupled by a hook and loop fastener system.

13. The apparatus of claim 1, wherein said second end of at least one of said first and second retainer straps comprises a connecting loop lock, said first end of at least one of said first and second retainer straps is detachably coupled to said connecting loop lock by a hook and loop fastener system.

14. The apparatus of claim 1, wherein at least one of said first and second retainer straps is detachably coupled by a side release buckle.

15. An apparatus for releasably securing a portable device to a wearer, said device having a substantially rectangular shape defined by a first pair of spaced apart generally vertical walls parallel to said article, a second pair of spaced apart generally vertical walls extending away from said apparatus and a pair of spaced apart generally horizontal walls at respective upper and lower ends of said first and second pairs of vertical walls, said apparatus comprising:

a harness for releasably securing the device around the wearer's chest; and first and second retainer straps for releasably retaining the device, each of said retainer straps having first and second ends, and each of said retainer straps having means for releasably engaging said first and second ends, said first and second retainer straps attached to said harness at a common attachment point, said first retainer strap attached to said harness in an orientation perpendicular relative to said second retainer strap, said first retainer strap attached longitudinally to said harness and said second retainer strap attached vertically to said harness, wherein said first and second retainer straps define a substantially rectangular space for retaining the device so that said longitudinally attached first retainer strap is positioned about said device to substantially engage said first and second pairs of spaced apart generally vertical walls, and said vertically attached second retainer strap is positioned about said device to substantially engage said first pair of spaced apart generally vertical walls and said pair of spaced apart generally horizontal walls.

16. The apparatus of claim 15, wherein said harness is adjustable.

17. The apparatus of claim 15, wherein at least one of said first and second retainer straps is adjustable.

18. The apparatus of claim 15, wherein at least one of said first and second retainer straps is detachably coupled by a hook and loop fastener system.

19. The apparatus of claim 15, wherein said second end of at least one of said first and second retainer straps comprises a connecting loop lock, said first end of at least one of said first and second retainer straps is detachably coupled to said connecting loop lock by a hook and loop fastener system.

20. The apparatus of claim 15, wherein at least one of said first and second retainer straps is detachably coupled by a side release buckle.

* * * * *